US005335499A

United States Patent [19]

Thompson et al.

[11] Patent Number: 5,335,499

[45] Date of Patent: Aug. 9, 1994

[54] MULTIPLE HYDRAULIC ACTUATORS WITH SERIES/PARALLEL OPERATION

[75] Inventors: Terrence L. Thompson, Minneapolis, Minn.; Jack W. Gresham, Armuchee, Ga.

[73] Assignee: Viking Engineering & Development, Incorporated, Fridley, Minn.

[21] Appl. No.: 950,252

[22] Filed: Sep. 24, 1992

[51] Int. Cl.[5] ..... F15B 7/00; F15B 11/00; F15B 13/00

[52] U.S. Cl. ..... 60/546; 91/512; 91/519; 91/520

[58] Field of Search ..... 91/178, 512, 517, 518, 91/519, 520, 534; 60/546

[56] References Cited

U.S. PATENT DOCUMENTS

| | | | |
|---|---|---|---|
| 1,944,351 | 1/1934 | Landry | 91/520 X |
| 2,292,278 | 8/1942 | Lorenz | 60/546 |
| 3,422,727 | 1/1969 | Pearson | 91/520 X |
| 3,476,016 | 11/1969 | Dixon et al. | 91/520 |
| 3,625,305 | 12/1971 | Mueller et al. . | |
| 3,722,366 | 3/1973 | Richardson | 91/520 X |
| 4,782,989 | 11/1988 | Wallin et al. . | |
| 4,867,364 | 9/1989 | Wallin et al. . | |
| 5,110,251 | 5/1992 | Gray | 91/520 X |

FOREIGN PATENT DOCUMENTS

| | | | |
|---|---|---|---|
| 830019 | 7/1938 | France | 91/520 |
| 567855 | 8/1977 | U.S.S.R. | 91/520 |

*Primary Examiner*—Edward K. Look
*Assistant Examiner*—John Ryznic
*Attorney, Agent, or Firm*—Kinney & Lange

[57] ABSTRACT

The present invention includes a method for improving operating efficiency of a hydraulic actuator loop and an improved hydraulic actuator loop. The method includes transferring hydraulic fluid between a first and a second hydraulic actuator when the actuators are disengaged from a load and transferring hydraulic fluid from an energy source to each of the actuators separately when the actuators engage the load. The method also includes transferring fluid from the energy source to the first actuator when the actuators are approaching the load and transferring fluid from the first actuator to a drain when the actuators are retracting from the load.

10 Claims, 5 Drawing Sheets

MULTIPLE HYDRAULIC ACTUATORS WITH SERIES/PARALLEL OPERATION

BACKGROUND OF THE INVENTION

The present invention relates to an improved method for driving loads with hydraulic actuators.

Hydraulic actuators are used to convert energy such as is found in a pressurized fluid into mechanical motion that can displace a load. The mechanical motion includes a linear push or a pull that produces a change in elevation in a load. The mechanical motion also includes rotary and oscillatory motion.

One type of hydraulic actuator commonly used to provide a fixed length of linear motion is a linear cylindrical actuator. The linear cylindrical actuator includes a closed cylinder and a piston tightly fitted within the cylinder. The piston is attached to a rod extending from one end of the closed cylinder. The rod of the actuator engages and drives the load. The piston is fitted within the cylinder so that the piston can be pushed toward the load or away from the load in the cylinder in response to the rod engaging or disengaging the load.

The piston divides the closed cylinder into two sections, a section including the rod, a "rod section," and a section without the rod, a "rod-free" section. As the piston is moved toward the load, the rod section of the closed cylinder decreases in volume and the rod-free section increases in volume.

The piston is also pushed toward the load or away from the load by pressurized hydraulic fluid in at least one of the rod or rod-free sections of the closed cylinder. At least one of the rod and rod-free sections has a portal for a feed or exhaust of the pressurized hydraulic fluid. The pressurized hydraulic fluid fills at least one of the two cylinder sections through the portal. The hydraulic fluid is typically pressurized by a pump.

The pump is placed in communication with one or more cylindrical actuators by a piping network through which pressurized hydraulic fluid is transferred. One type of piping network is a parallel piping network. In the parallel piping network, a first and second actuating cylinder separately and concurrently receive fluid pressurized by the pump. For a situation where both of the actuators are engaging the same load, the actuators separately receive pressurized fluid through the portal in the rod-free section of each actuator to push the piston and rod of each actuator toward the load. The actuators separately and concurrently exhaust fluid from the rod-free section of each actuator into a tank to move the piston and rod of each actuator away from the load.

One disadvantage of the parallel, concurrent transmittal of hydraulic fluid is that when the pistons are moved toward the load by pressurized hydraulic fluid to cause the rods to approach but not to engage the load, the pressurized hydraulic fluid has an excess energy that is undesirably dissipated as heat. The excess energy arises because the hydraulic fluid is fully pressurized by the pump but the actuators are not engaging and driving a load. A generation of heat by the excess energy is undesirable because heat elevates the temperature of the hydraulic fluid beyond acceptable limits.

Another type of piping network is a series piping network. In a series piping network, pressurized hydraulic fluid is transferred from the pump to one of the sections of the first cylindrical actuator and then to one of the sections of the second cylindrical actuator. A series piping network reduces the volume of hydraulic fluid required to move pistons and rods of the actuators as compared to the parallel network. This is because the separate inlet and exhaust piping required for each actuator in the parallel network is not required in the series network. However, the series network requires that pump pressure be increased over what is required by a parallel network to move a given load. This is because the pump must pressurize a single long network of at least two actuators rather than the shorter separate parallel networks of each actuator.

SUMMARY OF THE INVENTION

The present invention includes an improved method for efficiently supplying pressurized hydraulic fluid to a first and a second hydraulic actuator. The method includes permitting flow of hydraulic fluid from the first actuator to the second actuator when the actuators are at rest. The method also includes permitting flow from the second actuator to the first actuator and further permitting flow to the first actuator from an energy source to uniformly move the actuators toward a load. The method also includes transferring pressurized hydraulic fluid from the energy source to each of the first and second actuators separately and concurrently when the actuators engage and drive the load. The method further includes draining hydraulic fluid from the first actuator to the second actuator and concurrently from the first actuator to a drain in order to uniformly retract the actuators from the load.

The present invention also includes an improved loop for implementing the method of the present invention. The improved loop includes a first and a second actuator in communication with an energy source for moving a load with hydraulic fluid and energy transferred to the actuators from the energy source. The loop includes a network for transferring hydraulic fluid between the first and the second hydraulic actuator when the actuators are disengaged from the load. The loop also includes a network for transmitting energy in hydraulic fluid from the energy source to each of the first and the second hydraulic actuators separately when the actuators engage and drive the load. The loop further includes a network for transmitting energy in hydraulic fluid from the energy source to the first actuator when the actuators are approaching the load and from the first actuator to a drain when the actuators are retracting from the load.

DETAILED DESCRIPTION OF THE PREFERRED EMBODIMENTS

Figure 1:
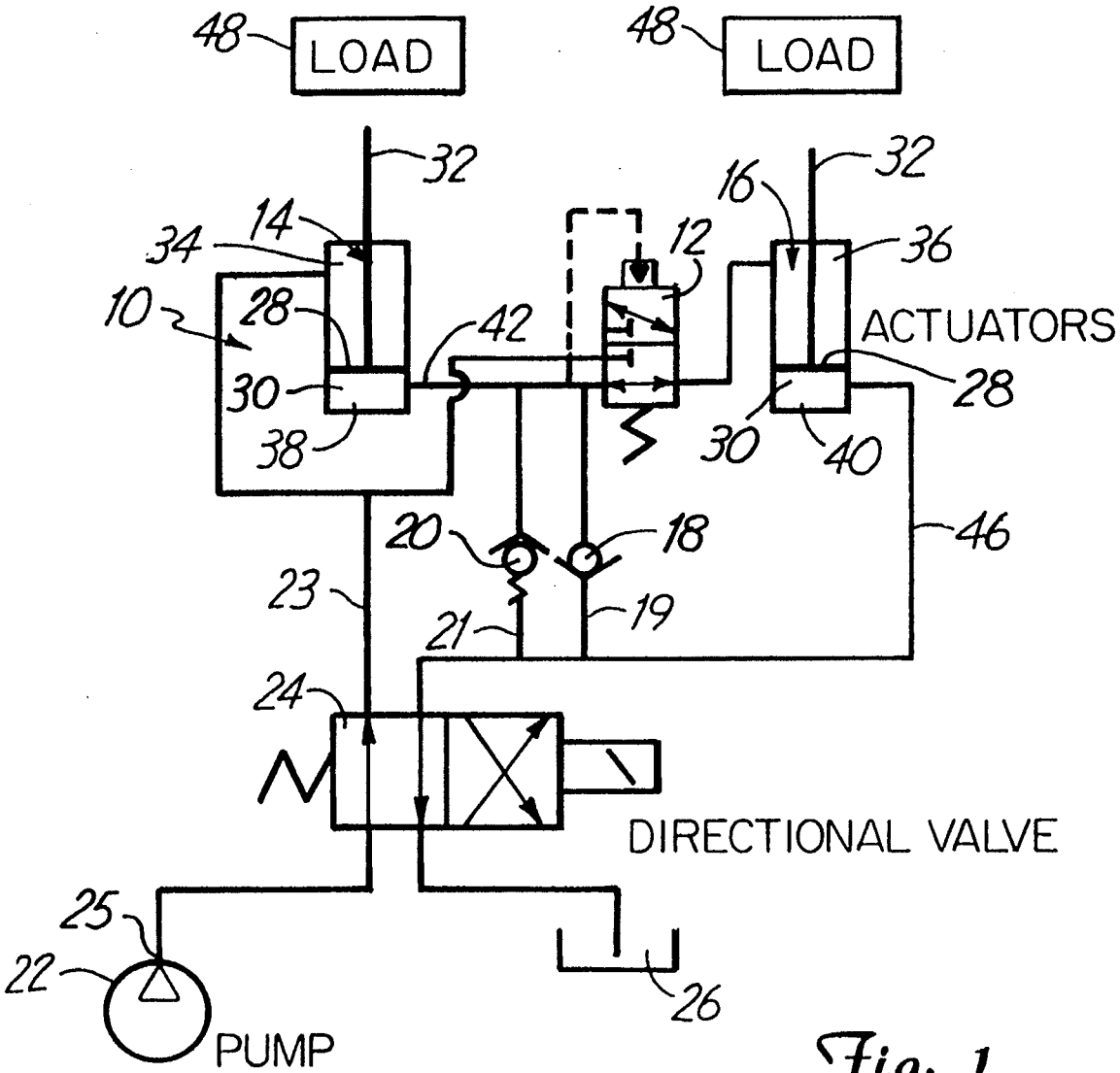
FIG. 1 illustrates one embodiment of the loop of the present invention when a first and second hydraulic actuator are at rest.

The present invention includes an improved method for efficiently supplying pressurized hydraulic fluid to a first and a second hydraulic actuator that are in communication with an energy source, such as a pump. The method includes permitting a flow of hydraulic fluid from the first actuator to the second actuator when the actuators are at rest. The method also includes permitting a flow of pressurized hydraulic fluid from the second actuator to the first actuator and further permitting flow to the first actuator from the energy source to cause the actuators to approach the load at the same time. The method further includes transferring pressurized hydraulic fluid from an energy source to each of the actuators separately and concurrently when the actuators engage and drive a load in order to efficiently pressurize the actuators. The method also includes draining the first actuator into the second actuator and concurrently draining the first actuator to a tank to retract the actuators from the load at the same time.

The present invention also includes an improved loop for performing the method of the present invention. The improved loop, illustrated at 10 in FIG. 1, includes a first 14 and a second 16 hydraulic actuator connected to each other by a crosstie line 42 and connected to a pump 22 by a feed line 23 and a drain line 46 that drains into a tank 26.

The crosstie line 42 includes a diverter valve 12 that permits a flow of hydraulic fluid between the first 14 and second 16 actuator in a low pressure position and blocks the flow of hydraulic fluid between the actuators 14 and 16 in a high pressure position.

The drain line 46 is connected to the crosstie line 42 by a low pressure line 19 having a low pressure check valve 18 and a high pressure line 21 having a high pressure check valve 20, respectively. The low pressure line 19 is connected to the crosstie line 42 between the diverter valve 12 and the first hydraulic actuator 14. The high pressure line 21 is connected to the crosstie line 42 between the connection of line 19 and the first hydraulic actuator 14.

The feed line 23, connecting the pump 22 to the actuators 14 and 16, includes a directional valve 24 positioned at a discharge 25 of the pump 22. A hydraulic fluid (not shown) is transmitted and pressurized at a low pressure by the pump 22. The pump draws unpressurized hydraulic fluid from a line (not shown) connected to a feed tank (not shown). The pump 22 is preferably a pressure compensated pump. The pump is acceptably a constant pressure pump or a constant volume pump.

The directional valve 24 typically has a spool-like symmetry with a plurality of vanes radially positioned about the spool (not shown). The directional valve 24 directs a flow of hydraulic fluid from the pump 22 to the first hydraulic actuator 14 at a low pressure position and directs a flow from the pump 22 to the second hydraulic actuator 16 at a high pressure position, illustrated in FIG. 2.

The hydraulic actuators 14 and 16 are most preferably linear cylinder actuators as shown in FIG. 1. The linear cylinder actuators 14 and 16 each include a tight-fitting piston 28 moving in a closed cylinder 30. The piston 28 is attached to a rod 32 that extends from one end of the cylinder to provide a mechanical output. The closed cylinder 30 of each linear cylinder actuator 14 and 16 includes two sections, a rod section, illustrated at 34 for the first actuator 14 and at 36 for the second actuator 16, and a rod-free section, illustrated at 38 for the first actuator 14 and at 40 for the second actuator 16. The crosstie line 42 is connected to the first actuator 14 at the rod-free section 38 and is connected to the second actuator 16 at the rod section 36.

The crosstie line 42, feed line 23, drain line 46, low pressure line 19 and high pressure line 21 are preferably made of a flexible material. The lines 42, 23, 46, 19 and 21 are suitably made from an inflexible material. The lines 42, 23, 46 and 19 have the physical and chemical features to convey hydraulic fluid within a pressure range of about 10 to 5000 psig. The loop 10, as illustrated in FIG. 1, shows the hydraulic actuators 14 and 16 in a rest position. By "rest position" is meant that the piston 28 and rod 32 of each actuator 14 and 16 are not engaging a load or approaching a load or retracting from a load.

In the rest position, hydraulic fluid may be transferred to maintain the piston 28 of each actuator 14 and 16 at its lowest position. The transfer of hydraulic fluid is from the pump 22 to the rod section 34 of the first actuator 14. This transfer pushes down the piston 28 of the first actuator 14 and decreases the volume of the rod-free section 38. Decreasing the volume of the rod-free section 38 displaces hydraulic fluid into the crosstie line 42. The displaced hydraulic fluid is transferred to the rod section 36 of the second actuator 16 by passage through the diverter valve 12 and crosstie line 42. The displaced hydraulic fluid pushes down the piston 28 of the second actuator 16 which decreases the volume of the rod-free section 40. The decrease in volume of the rod-free section 40 displaces hydraulic fluid into the drain line 46. The displaced fluid is transferred to the tank 26. This method of transferring hydraulic fluid from the first actuator 14 to the second actuator 16 in series when the actuators are at rest permits the loop 10 to be operated at a low hydraulic fluid flow.

Figure 2:
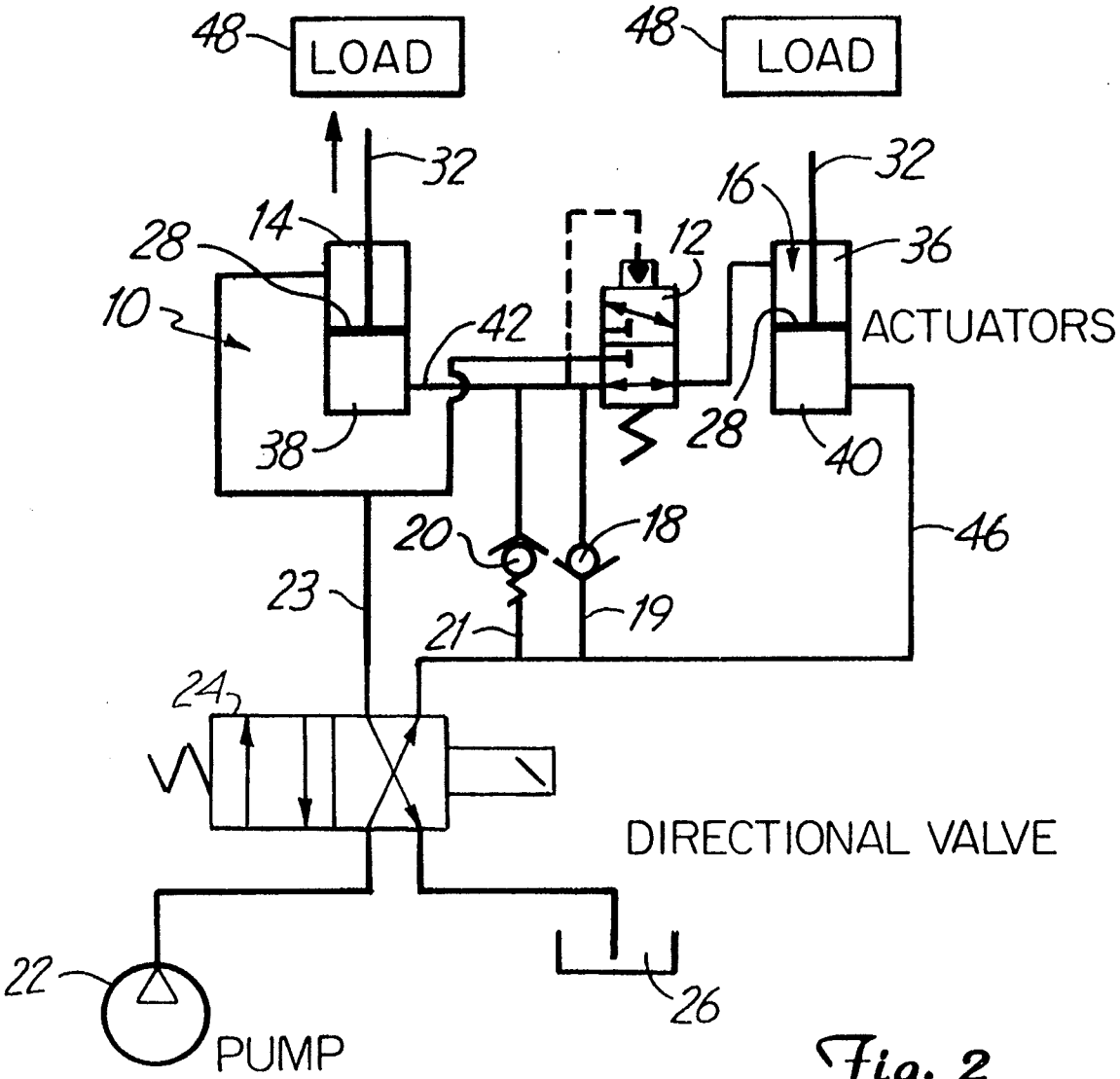
FIG. 2 illustrates one embodiment of the loop of the present invention when the first and second hydraulic actuator approach a load.

The loop 10, as illustrated in FIG. 2, shows the first 14 and the second 16 actuator approaching a load 48. Specifically, FIG. 2 shows the piston 28 and rod 32 of each actuator 14 and 16 pushed toward the load 48 by hydraulic fluid.

To approach the load 48, the hydraulic actuators 14 and 16 are driven by hydraulic fluid having an increased energy content. The increased energy content results from an increase in pressure of the hydraulic actuation loop 10. The increase in pressure occurs when the directional valve 24 changes to a position that blocks the drain line 46 from draining into the tank 26. As shown in FIG. 2, the directional valve's 24 position is changed so that hydraulic fluid is transferred from the pump 22, through the drain line 46, to the rod-free section 40 of the second hydraulic actuator 16.

The transfer of pressurized fluid drives the piston 28 of the second actuator 16 upwards to engage the load 48. As the piston 28 moves upward, the volume of the rod section 36 decreases and displaces hydraulic fluid into the crosstie 42. The displaced fluid is then transferred from the rod section 36 to the rod-free section 38 of the first actuator 14 through the crosstie 42. The displaced fluid transferred to the rod-free section 38 of the first actuator 14 pushes the piston 28 upwards.

However, the displaced fluid transferred from the second actuator 16 to the first actuator 14 does not have a volume that will push the piston 28 of the first actuator 14 upwards to the same level as the piston of the second actuator 16. This is because the fluid is transferred from the rod section 36 of the second actuator 16 to the rod-free section 38 of the first actuator 14. The volume transferred does not include the volume of displaced rod.

In order to equalize hydraulic fluid added to the two actuators 14 and 16, fluid is also transferred to the rod-free section 38 of the first actuator 14 by passage through the line 19 that includes the low pressure check valve 18. The fluid transferred through the low pressure check valve 18 has a volume about the same as the volume of the displaced rod 32 in the rod section 36 of the second actuator 16.

The transfer of hydraulic fluid illustrated in FIG. 2 includes a series transfer between the two actuators 14 and 16 and a parallel transfer from the pump 22 separately to each of the first 14 and second actuators 16.

Figure 3:
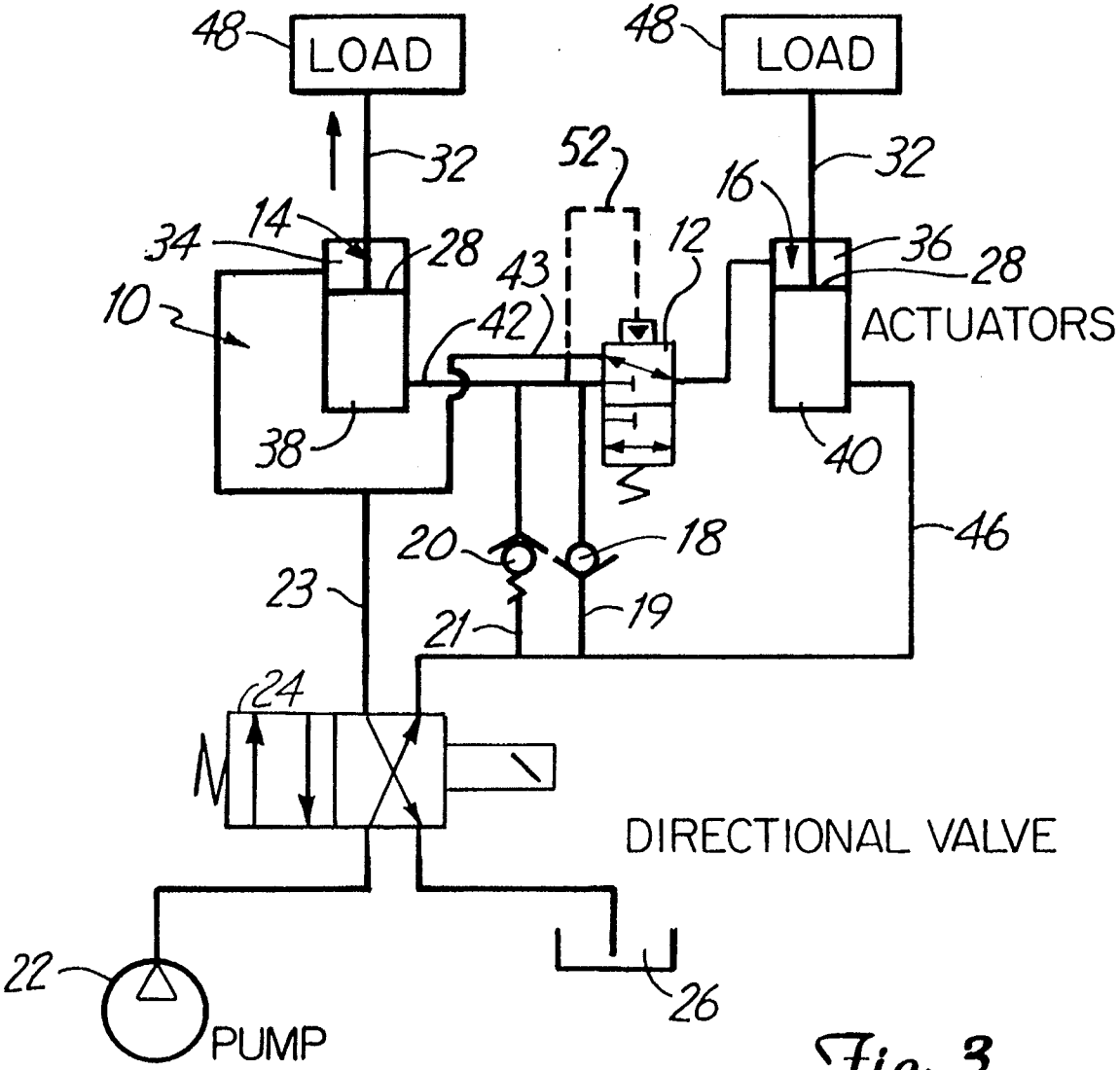
FIG. 3 illustrates one embodiment of the loop of the present invention when the first and second hydraulic actuator engage a load.

The loop 10, as illustrated in FIG. 3, shows the first 14 and the second 16 actuator engaging the load 48. Once the actuators 14 and 16 engage the load, the load 48 applies a force to the actuators 14 and 16 that the actuators must overcome to move the load 48. The force applied to the actuators 14 and 16 increases pressure of the hydraulic fluid in the loop 10 by pushing on the piston 28 of each cylinder 14 and 16.

To engage the load 48 and move the load 48, it is most preferable that a maximum pump pressure be available to the actuators 14 and 16. This maximum pressure is developed when the pressure increase caused by the load 48 pushing down on the piston 28 of one of the actuators 14 and 16 is sensed by a pressure sensing line 52 on the diverter valve 12. The increase in pressure prompts the diverter valve 12 to shift. When the diverter valve 12 shifts, any hydraulic fluid displaced from the rod section 36 of the second hydraulic actuator 16 is transferred to the tank 26 by passage through the diverter valve 12, a line 43 activated by the change of position of the diverter valve 12, the feed line 23 that is connected to both the line 43 and the directional valve 24.

As a consequence of the diverter valve 12 shifting, hydraulic fluid is transferred to the rod-free section 40 of the hydraulic actuator 16 from the pump 22 through line 46. Hydraulic fluid is also transferred to the rod-free section 38 of the hydraulic actuator 14 from the pump 22, through line 19 and through the low pressure check valve 18. However, hydraulic fluid cannot be transferred from the hydraulic actuator 16 to the hydraulic actuator 14 because of the blocking position of the diverter valve 12.

Thus, when the hydraulic actuator loop 10 operates at a maximum operating pressure, the pressure required to engage and move the load 48, the loop 10 provides that a maximum pump energy is available. The loop 10 achieves the provision by positioning the directional valve 24 and the diverter valve 12 to supply hydraulic fluid from the pump 22 to the actuators 14 and 16 in parallel.

Figure 4:
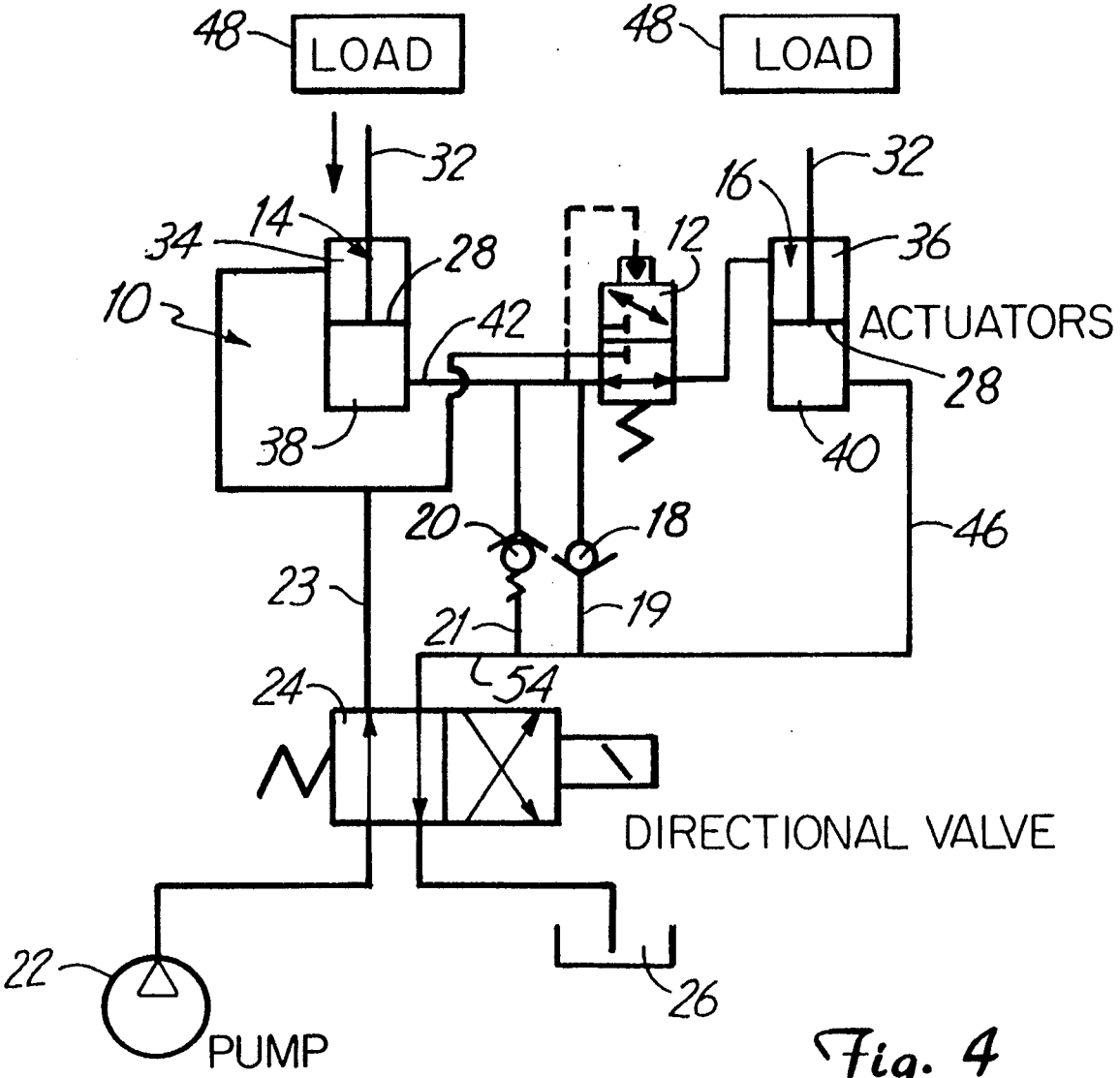
FIG. 4 illustrates one embodiment of the loop of the present invention when the first and second hydraulic actuator have moved a load and are retracting from the load.

The loop 10, as illustrated in FIG. 4, shows the actuators 14 and 16 disengaged from the load 48 and retracting from the load 48. The removal of the load 48 reduces pressure on the actuator loop 10 because the force pushing downward on each piston 28 of the actuators 14 and 16 by the load 48 is removed. The reduction in pressure is sensed by instruments (not shown) in communication with the directional valve 24 and the diverter valve 12. In response to the reduction in pressure, the directional valve 24 is prompted to reposition so that a flow of hydraulic fluid from the pump 22 through the directional valve 24 is transferred to the rod section 34 of the first hydraulic actuator 14 by line 23. The hydraulic fluid transferred to the rod section 34 pushes the piston 28 downward and reduces the volume of the rod-free section 38. The reduction in volume of the rod-free section 38 displaces hydraulic fluid into the crosstie line 42. The displaced hydraulic fluid is transferred to the rod section 36 of the second actuator 16 and pushes down the piston 28 of the second actuator. As the piston 28 is pushed downward, the volume of the rod-free section 40 is decreased, displacing hydraulic fluid into line 46 and to the tank 26.

The transfer of hydraulic fluid from the rod-free section 38 of the first actuator 14 to the rod-section 36 of the second actuator 16 pushes the piston 28 of the second actuator 16 downward a greater distance than the piston 28 of the first actuator 14. This is because the rod 32 of the rod section 36 displaces a volume not displaced in the rod-free section 38.

In order to prevent this uneven displacement, hydraulic fluid from the rod-free section 38 of the hydraulic actuator 14 is also transferred to the tank 26 through the line 21 that includes the high pressure check valve 20. The hydraulic fluid that is transferred through the high pressure check valve 20 has a volume that is about equal to the displaced volume of the rod 32. The line 54 is connected to the drain line 46.

Figure 5:
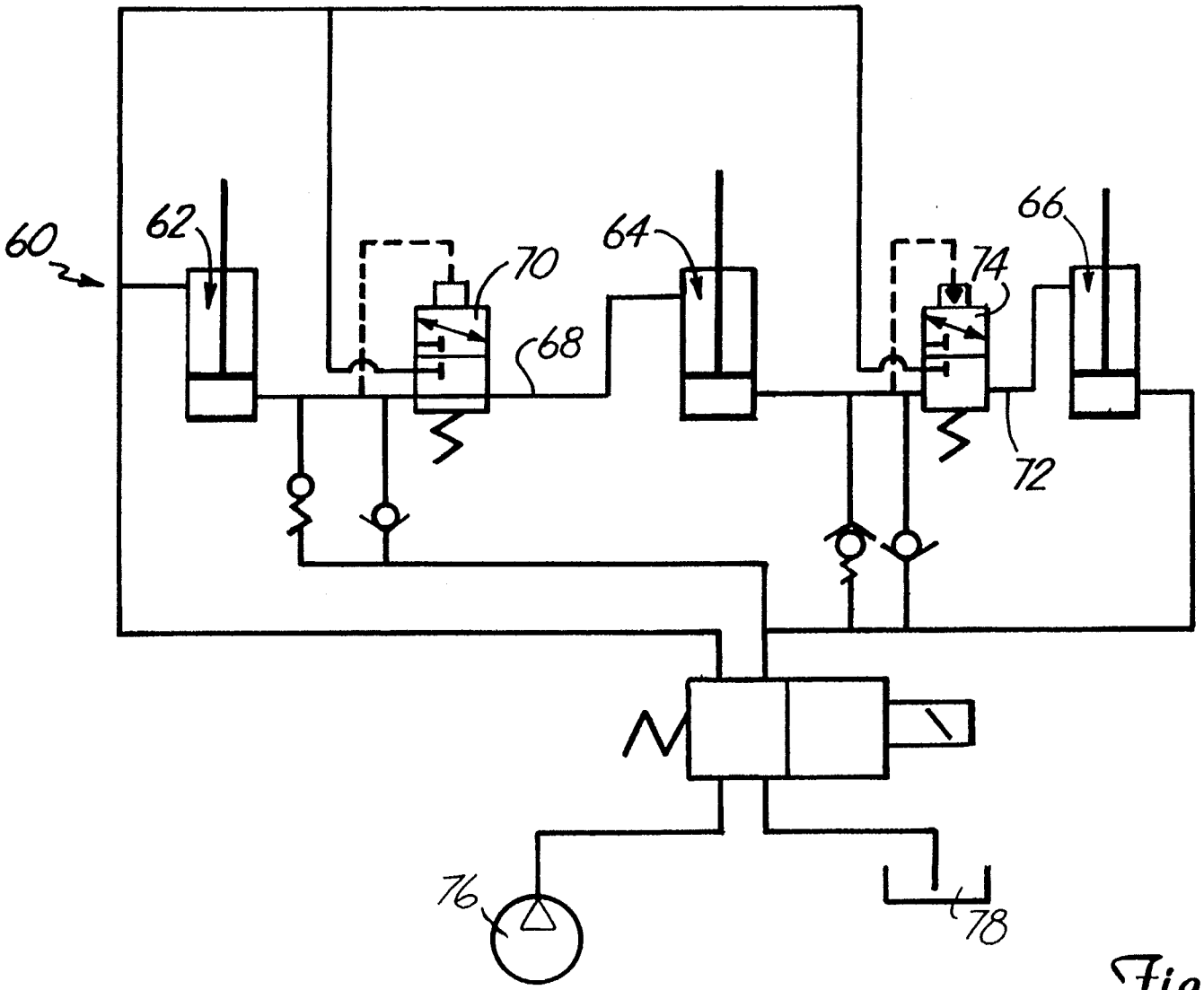
FIG. 5 illustrates one other embodiment of the loop of the present invention having a first, second and third hydraulic actuator when the first, second and third actuators are at rest.

The loop of the present invention includes an embodiment having more than two actuating cylinders as is illustrated at 60 in FIG. 5. The loop 60 includes a first, second and third actuating cylinder 62, 64 and 66, respectively. The first and second actuating cylinders 62 and 64 are connected by a first crosstie line 68 having a diverter valve 70. The second and third actuating cylinders 64 and 66 are connected by a second crosstie line 72 having a diverter valve 74.

The loop 60 as illustrated in FIG. 5 shows the actuators 62, 64 and 66 at rest. The loop 60 is operated by essentially the same method as is used for the loop 10 having two actuating cylinders. The loop 60 permits a flow of hydraulic fluid from the first actuating cylinder 62 to the second actuating cylinder 64 and from the second actuating cylinder 64 to the third actuating cylinder 66 when the actuators are at rest.

The loop 60 also permits a flow of pressurized hydraulic fluid from the third actuator 66 to the second actuator 64 and from the second actuator 64 to the first actuator 62 as the actuators 62, 64 and 66 approach a load (not shown). The loop 60 further permits a flow of pressurized hydraulic fluid to the first actuator 62 and to the second actuator 64 from a pump 76 to cause the actuators 62, 64 and 66 to approach the load (not shown) at the same time.

The loop 60 also transfers pressurized hydraulic fluid from the pump 76 to each of the actuators 62, 64 and 66 separately and concurrently when the actuators 62, 64 and 66 engage and drive the load (not shown) in order to efficiently pressurize the actuators.

The loop 60 also drains the first actuator 62 into the second actuator 64 and the second actuator 64 into the third actuator 66 as the actuators retract from the load. The loop 60 concurrently drains the first actuator 62 and the second actuator 64 to a tank 78 to retract the actuators 62, 64 and 66 from the load at the same time.

The method and loop of the present invention are usable for moving separate loads with each actuating cylinder. The method and loop are also usable for moving a single load with two or more actuating cylinders.

The loop of the present invention has an improved efficiency and moves a load faster than a loop where actuators are connected only in parallel with a pump. The improved efficiency occurs because the loop of the present invention decreases waste heat generated in hydraulic fluid when the rods of actuating cylinders move through a distance, s, as compared to rods of actuating cylinders in the parallel loop.

Heat losses in a hydraulic actuator loop having linear cylindrical actuators can be described generally by the equation $W=\Delta pV$, where $\Delta p$=pump pressure—tank pressure. Tank pressure is approximately equal to 0. Therefore, $\Delta p$ is equal to pump pressure.

V=the volume of hydraulic fluid displaced or made-up as the piston and rod travel the distance, s. For the parallel loop, V=two multiplied by the cylinder area multiplied by s. This is because the pump must increase pressure in the rod-free sections of two cylindrical actuators. The volume displaced in each of the two actuators is the cylinder area multiplied by s. Thus, the work lost as heat in a parallel loop is equal to two multiplied by the pump pressure multiplied by the cylinder area multiplied by s.

For the loop of the present invention, V is equal to the cylinder area plus the rod area, the sum of which is multiplied by s. This is because the actuator rods are displaced by transferring fluid from a rod section of one actuator to a rod-free section of another actuator. The total make-up volume is then the volume of the second actuating cylinder made up by the transfer of fluid from the pump and the extra rod volume made-up to the first actuating cylinder by the pump. The work lost is equal to pump pressure multiplied by the sum of cylinder area and rod area multiplied by s.

A ratio of work lost in the loop of the present invention and work lost in a parallel loop is equal to the cylinder area plus the rod area divided by two multiplied by the cylinder area. Thus, the work lost to heat in the process of the present invention approaches one half of the heat lost in a parallel loop as the displaced rod area approaches 0.

Further, the loop of the present invention will cause the piston and rod of the actuated cylinders to move through the distance, s, faster than in a parallel loop. For a parallel loop, the velocity of movement for the piston of the cylindrical actuator is $Q/2A_1$ where Q=pump flow and $A_1$=cylinder area.

In the loop of the present invention, the velocity is $$Q/(A_1+A_2),$$

where $A_2$=rod area.

When $A_2$ is a small number, the rod velocity of the loop of the present invention approaches two multiplied by that of the parallel loop.

An example of the use of the method and loop of the present invention is in a co-pending patent application entitled "Automated Nailing Device" filed on even date herewith and assigned to the same Assignee which is herein incorporated by reference.

Although the present invention has been described with reference to preferred embodiments, workers skilled in the art will recognize that changes may be made in form and detail without departing from the spirit and scope of the invention.

What is claimed is:

1. A loop having a first and a second hydraulic actuator in communication with an energy source for moving a load with hydraulic fluid and energy transferred to the actuators from the energy source, the loop comprising:

a series network for transferring hydraulic fluid between the first and the second hydraulic actuators when the actuators are disengaged from the load;

a parallel network for transferring energy in hydraulic fluid from the energy source to each of the first and the second hydraulic actuators separately when the actuators engage the load, the parallel network including means for blocking transfer of the hydraulic fluid between the first and second actuators when at least one actuator engages the load; and a series-parallel network;

for transferring fluid from the second actuator to the first actuator and for transmitting energy in hydraulic fluid from the energy source to the first actuator when the actuators are approaching the load; and for transferring fluid from the first actuator to the second actuator and for transferring fluid from the first actuator to a drain when the actuators are retracting from the load, the loop only switching from the series-parallel network to the parallel network when a load is applied to both of the actuators.

2. The loop of claim 1 wherein the series network includes a crosstie line for transferring hydraulic fluid between the first and the second hydraulic actuator when the actuators are not engaging the load.

3. The loop of claim 1 wherein the series network includes a first transmitting line for transmitting energy in hydraulic fluid from the energy source to the first actuator to cause the actuator to move away from the load.

4. The loop of claim 1 wherein the series network includes a second transmitting line for transmitting energy in hydraulic fluid from the energy source to the second actuator to cause the actuator to move toward the load.

5. The loop of claim 1 and further including a means for changing a transmitting of energy in hydraulic fluid from the energy source to either one of the first or the second actuator.

6. The loop of claim 5 wherein the means for changing a transmitting of energy in hydraulic fluid from the energy source to either one of the first or the second actuator is a directional valve.

7. The loop of claim 1 wherein the means for blocking transfer of hydraulic fluid between the first and second actuators when at least one of the actuators engages the load is a diverter valve.

8. The loop of claim 1 wherein the parallel network includes a high pressure feed-low pressure relief line having means for blocking flow at low pressure and for permitting flow at high pressure.

9. The loop of claim 8 wherein the means for blocking flow at low pressure and for permitting flow at high pressure is a low pressure check valve.

10. The loop of claim 1 wherein the means for blocking flow at high pressure and permitting flow at low pressure is a high pressure check valve.

* * * * *

UNITED STATES PATENT AND TRADEMARK OFFICE

CERTIFICATE OF CORRECTION

PATENT NO. : 5,335,499

DATED : August 9, 1994

INVENTOR(S) : TERRENCE L. THOMPSON, JACK W. GRESHAM

It is certified that error appears in the above-indentified patent and that said Letters Patent is hereby corrected as shown below:

Col. 7, line 11, delete "pressure-tank", insert --pressure - tank--

Col. 8, line 17, delete "network", insert --network:--

Signed and Sealed this

Twenty-seventh Day of December, 1994

*Attest:*

Bruce Lehman

BRUCE LEHMAN

*Attesting Officer*

*Commissioner of Patents and Trademarks*